US008764492B2

(12) United States Patent
Chiang

(10) Patent No.: US 8,764,492 B2
(45) Date of Patent: Jul. 1, 2014

(54) TERMINAL STRUCTURE OF CONNECTOR AND CONNECTOR PORT INCORPORATING SAME

(75) Inventor: Jui-Tu Chiang, New Taipei (TW)

(73) Assignee: Taiwin Electronics Co., Ltd., New Taipei (TW)

( * ) Notice: Subject to any disclaimer, the term of this patent is extended or adjusted under 35 U.S.C. 154(b) by 36 days.

(21) Appl. No.: 13/288,951

(22) Filed: Nov. 3, 2011

(65) Prior Publication Data

US 2012/0171906 A1 Jul. 5, 2012

Related U.S. Application Data

(60) Provisional application No. 61/409,985, filed on Nov. 4, 2010.

(51) Int. Cl.
*H01R 24/00* (2011.01)

(52) U.S. Cl.
USPC ..... 439/676; 439/862

(58) Field of Classification Search
USPC ..... 439/660, 676, 862
See application file for complete search history.

(56) References Cited

U.S. PATENT DOCUMENTS

| | | | | |
|---|---|---|---|---|
| 3,417,362 | A * | 12/1968 | Reynolds | 439/77 |
| 6,270,379 | B1 * | 8/2001 | Huang et al. | 439/660 |
| 2013/0078864 | A1 * | 3/2013 | Tsai et al. | 439/660 |
| 2013/0217267 | A1 * | 8/2013 | GUO, Rongzhe | 439/660 |
| 2013/0231009 | A1 * | 9/2013 | Jeon et al. | 439/660 |

* cited by examiner

*Primary Examiner* — Khiem Nguyen
(74) *Attorney, Agent, or Firm* — Leong C. Lei

(57) ABSTRACT

A terminal structure has a portion that is separated and bent. A projecting section is provided for realize common use. A connector port incorporating the terminal is also provided. The connector port includes a hollow shell receiving and retaining therein an insulation housing for receiving and positioning a plurality of terminals. Further, the insulation housing has at least one detection pin arranged at one side thereof. The detection pin is engageable with an external plug connector fit therein in order to prevent shorting caused by a shell of the plug contacting the terminals of the port at the time when the connectors mate each other. Further, the insulation housing includes a plurality of clamps, which functions to clamp and position an external plug connector so as to securely retain the plug that is fit into the socket and to realize stable engagement when the connector mate each other.

7 Claims, 14 Drawing Sheets

A - A

B - B

A - A

B - B

A - A

B - B

TERMINAL STRUCTURE OF CONNECTOR AND CONNECTOR PORT INCORPORATING SAME

CROSS-REFERENCE TO RELATED APPLICATION

This is a non-provisional patent application claiming priority of provisional patent application Ser. No. 61/409,985 filed Nov. 4, 2010.

TECHNICAL FIELD OF THE INVENTION

The present invention generally relates to an improved terminal structure of connector and a connector port incorporating the terminal, in which the terminal structure has a portion that is separated and bent to realize common use.

DESCRIPTION OF THE PRIOR ART

Development and progress of science and technology makes telecommunication products getting widely and increasingly popular. Various electronic devices are allowed to connect to each other by means of transmission cables for data transmission. The electronic devices are thus provided with a connector port for receiving insertion of a plug attached to an end of a transmission cable. To effectively mount terminals on a tongue plate for improving utilization of internal space of a connector, a solution adopted in the industry is to arrange terminals of several specifications on the same surface of a tongue plate inside a connector port, or an alternative design may be taken that terminals of the same specification are set on upper and lower surfaces of a tongue plate inside a connector port, in order to facilitate use by a user. Examples include Taiwan Utility Model Nos. M379258 and M385152.

Although such known arrangements and designs make the use convenient, yet such arrangements and designs may excessively increase the number of terminals, leading to increased difficulty of design of connector structure. Further, when a plug of a transmission cable is inserted into the connector port, the known arrangements and designs of the connector port may lead to undesired contact between a metal shell of the plug and the terminals inside the connector port, which may result in undesired shorting and thus affect the performance of the connector. Thus, it is desired to provide a solution to overcome the above discussed problems and the present invention aims to provide an improved terminal structure of connector and a connector port using same for solving the problems.

SUMMARY OF THE INVENTION

The present invention provides an improved terminal structure of connector and a connector port incorporating the terminal. The terminal has a structure of which a portion is separated and bent and also comprises a projecting section to realize common use. The connector port is electrically connectable to a predetermined electrical device and comprises a hollow shell that receives and retains therein an insulation housing receiving and positioning a plurality of terminals therein so as to electrically engage a plurality of terminals of an external plug when the external plug is inserted therein. Further, the insulation housing comprises at least one detection pin arranged at one side thereof. The detection pin is engageable with an external plug connector fit therein in order to prevent shorting caused by a shell of the plug contacting the terminals of the port at the time when the connectors mate each other. Further, the insulation housing comprises a plurality of clamps, which functions to clamp and position an external plug connector so as to securely retain the plug that is fit into the socket and to realize stable engagement when the connector mate each other.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
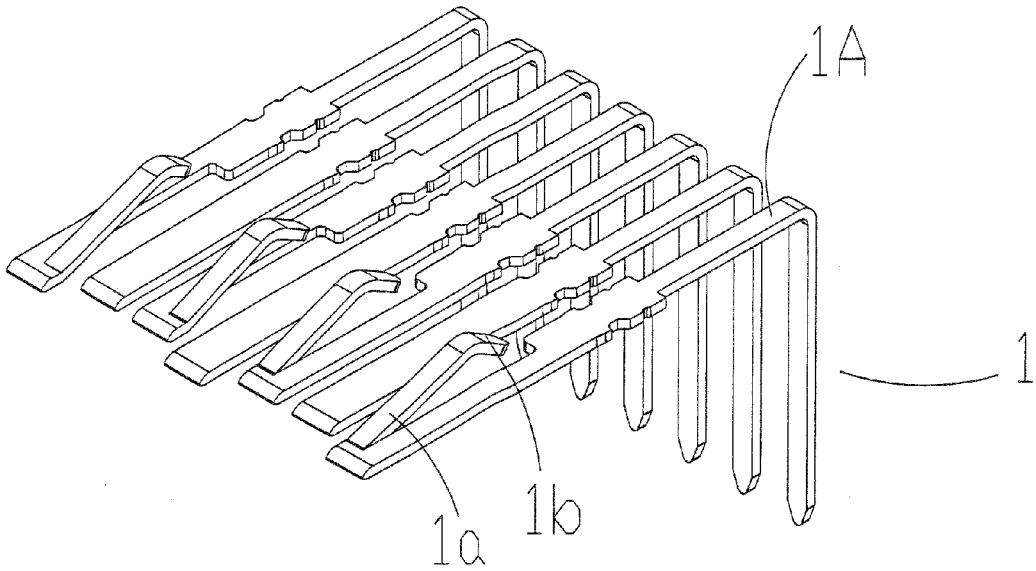
FIG. 1 is a perspective view showing an improved terminal structure according to the present invention.

Referring to FIG. 1, the present invention discloses an improved terminal structure of connector, which comprises a group of terminals, generally designated at 1. The terminal group 1 comprises at least one terminal 1A that has a front end having a portion that is inclined to form an inclination section 1*a* that is partially separated from the terminal 1A. The inclination section 1*a* is further extended in a substantially horizontal direction to then form a bent section 1*b*. When the terminal group 1 is set in a connector port, the bent section 1*b* of the terminal 1A is electrically engageable with a plurality of terminals of an external plug.

Figure 2:
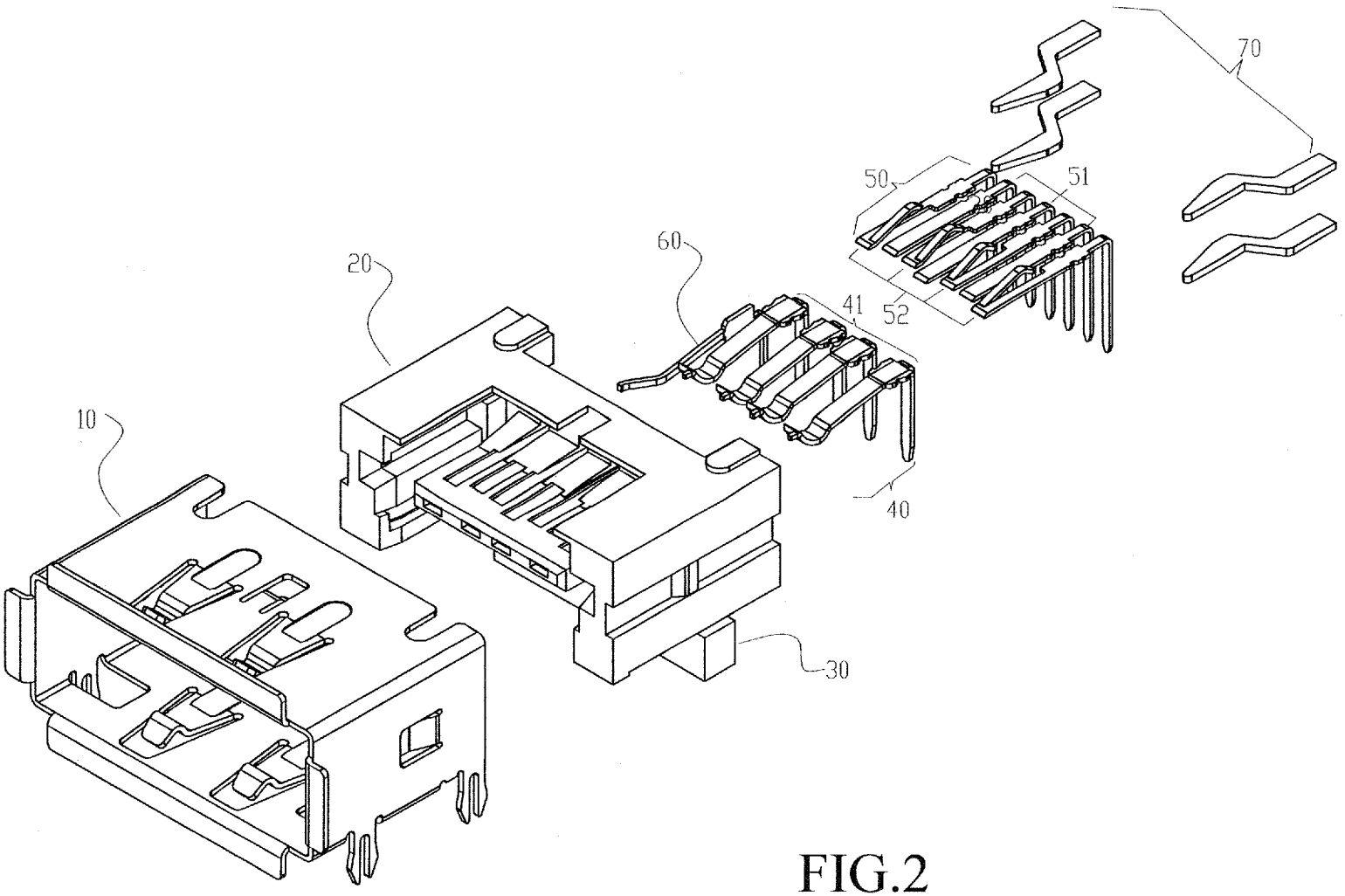
FIG. 2 is an exploded view of a connector port incorporating the terminals according to the present invention.
Figure 3:
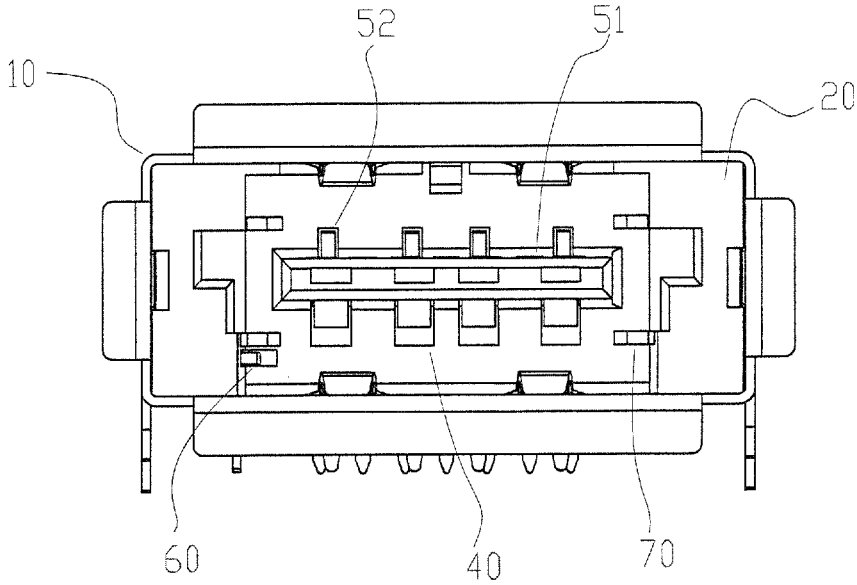
FIG. 3 is a front view of FIG. 2 in an assembled form.
Figure 4:
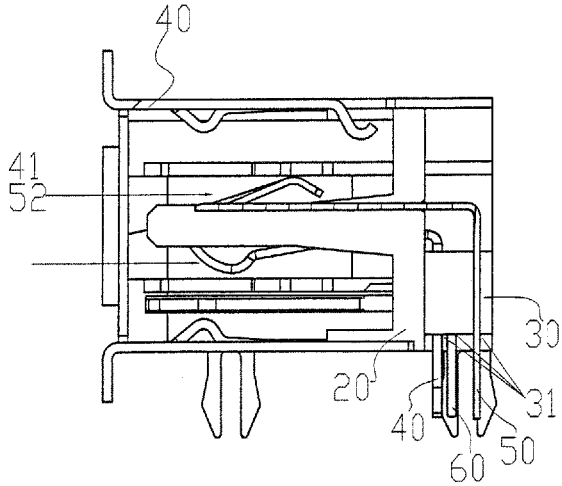
FIG. 4 is a cross-sectional view of FIG. 2 in an assembled form.
Figure 5:
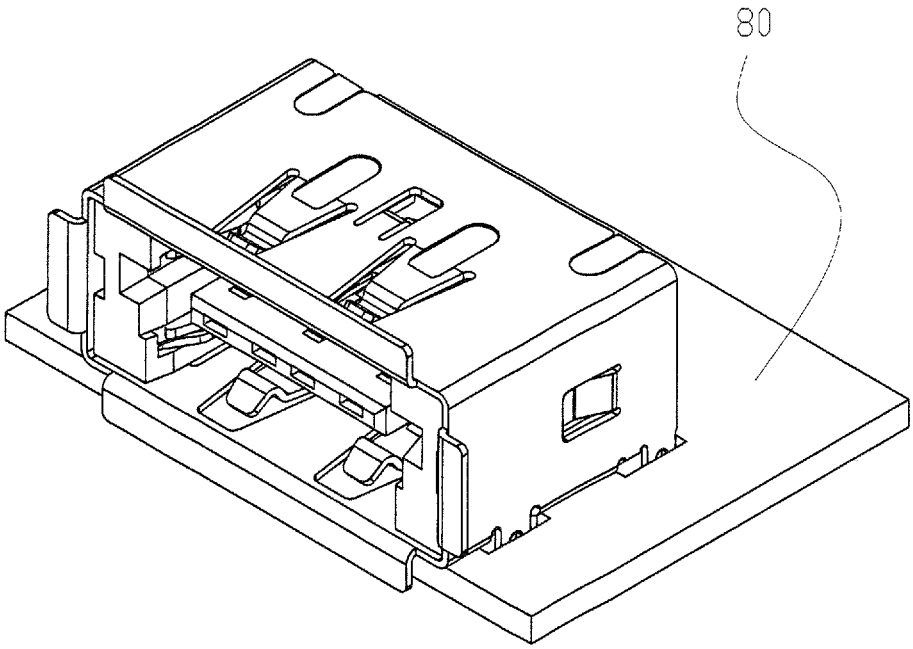
FIG. 5 is a perspective view showing a connector port incorporating the terminals according to the present invention mounted to a circuit board.
Figure 6:
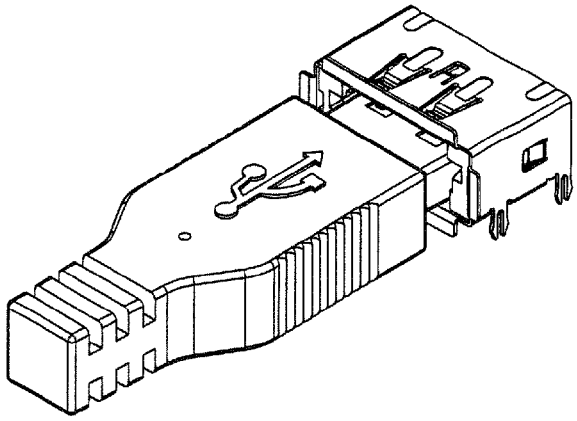
FIG. 6 is a perspective view showing an application of the connector port incorporating the terminals according to the present invention.
Figure 7:
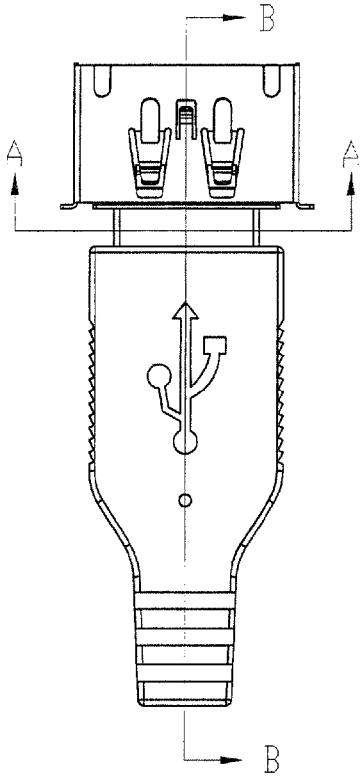
FIG. 7 is a plan view of FIG. 6.
Figure 7A:
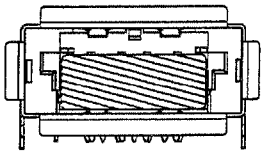
FIG. 7A is a cross-sectional view of FIG. 7.
Figure 7B:
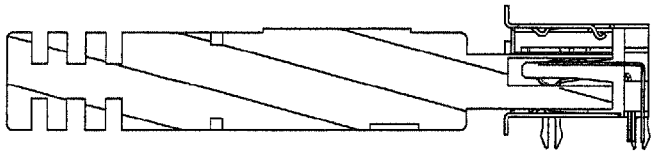
FIG. 7B is a cross-sectional view of FIG. 7.
Figure 8:
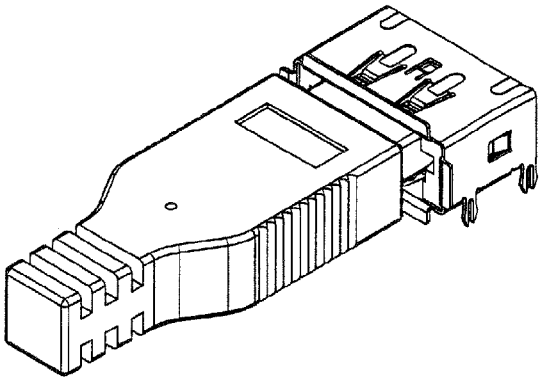
FIG. 8 is a perspective view showing another application of the connector port incorporating the terminals according to the present invention.
Figure 9:
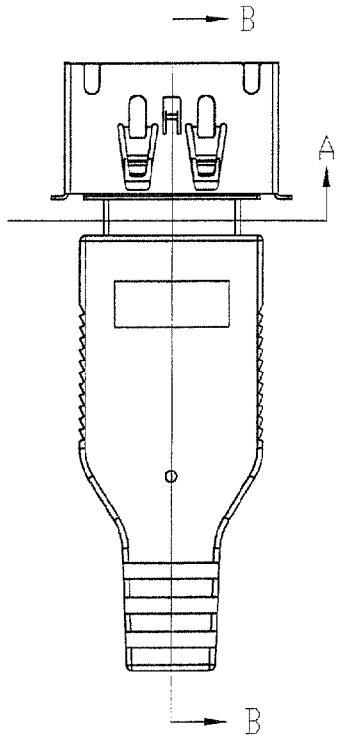
FIG. 9 is a plan view of FIG. 8.
Figure 9A:
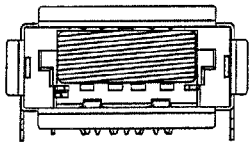
FIG. 9A is a cross-sectional view of FIG. 9.
Figure 9B:
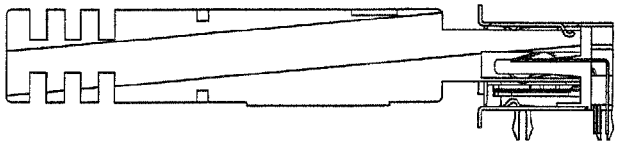
FIG. 9B is a cross-sectional view of FIG. 9.

Referring to FIG. 2, the present invention also discloses a connector port that uses the improved terminal, which comprises a hollow shell 10, an insulation housing 20, a retainer seat 30, a first terminal group 40, a second terminal group 50, a detection pin 60, and a plurality of clamps 70. The first terminal group 40 comprises a plurality of first terminals 41, and the plurality of first terminals 41 is terminals in compliance with the specification of universal serial bus (USB2.0A). The second terminal group 50 comprises a plurality of second terminals 51 and a plurality of third terminals 52. The pluralities of terminals 51, 52 are terminals in compliance with the specification of external SATA (eSATA), and the plurality of third terminals 52 is also terminals in compliance with the specification of universal serial bus (USB2.0A). The plurality of terminals 52 are of a curved structure and thus, the second terminal group 50 is the improved connector terminal group 1 and the plurality of terminals 52 are of the improved structure of the connector terminal 1A. The connector port further comprises a retainer seat 30. The retainer seat forms a plurality of slots 31 for receiving and positioning the first terminal group 40, the second terminal group 50, and the detection pin 60. The retainer seat 30 is coupled to the insulation housing 20 (see FIG. 4). The detection pin 60 is set at one side of the insulation housing 20 and the detection pin 60 is brought into contact engagement with an external plug connector that is fit into the receptacle in order to prevent shorting caused by a shell of the plug undesirably engaging the plurality of third terminals 52 located inside the connector port at the time when the connectors mate each other. The insulation housing 20 further comprises a plurality of clamps 70 arranged therein. The plurality of clamps 70 functions for clamping and positioning when the plug is fit into the connector port. Further, as shown in FIG. 3, the hollow shell 10 of the connector port accommodates the insulation housing 20 therein and thus forms an opening of variable width. The opening has an upper portion and a lower portion, which may individually receive a plug of the same specification to fit therein. The connector port may be mounted to a circuit board 80, as shown in FIG. 5, and forms electrical connection therebetween.

Referring to FIGS. 6-9, an application of the present invention is shown. When a plug is inserted into the connector port, the plurality of clamps 70 arranged inside the port clamps the plug in position and also provides a function of guiding and limiting the insertion of the plug. Further, the upper portion and the lower portion of the opening of the port can individually receive a plug of the same specification to insert therein. The plug of the same specification mentioned here is one complying with the specification of universal serial bus (USB2.0A). When the upper portion of the lower portion of the opening of the port receives a plug of the same specification therein, a plurality of terminals of the plug is set in electrical engagement with the plurality of first terminals 41 of the first terminal group 40 or the plurality of third terminals 52 of the second terminal group 50. A shell of the plug is brought into engagement with and thus activate the detection pin 60 arranged by the insulation housing 20 of the port in order to prevent shorting caused by the shell of the plug connector engaging the plurality of terminals inside the port at the time when the connectors mate each other.

Figure 10:
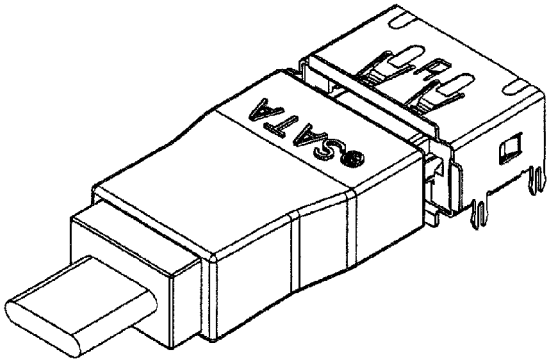
FIG. 10 is a perspective view showing a further application of the connector port incorporating the terminals according to the present invention.
Figure 11:
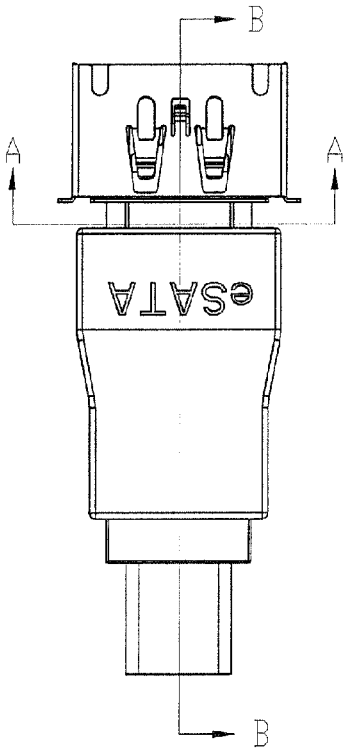
FIG. 11 is a plan view of FIG. 10.
Figure 11A:
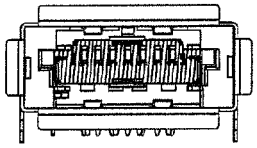
FIG. 11A is a cross-sectional view of FIG. 11.
Figure 11B:
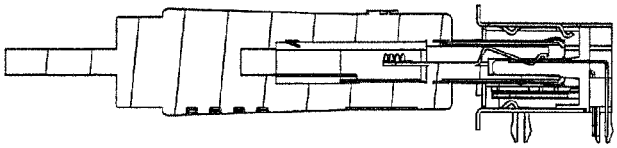
FIG. 11B is a cross-sectional view of FIG. 11.

Further, referring to FIGS. 10 and 11, another application of the present invention is shown. When a plug is inserted into the connector port, the plurality of clamps 70 arranged inside provides a function of positioning so that when the plug is received in the connector port, a plurality of terminals of the plug is simultaneously brought into electrical engagement with the plurality of second terminals 51 and the plurality of third terminals 52 of the second terminal group 5. The plug mentioned here is one complying with the specification of external SATA (eSATA).

Figure 12:
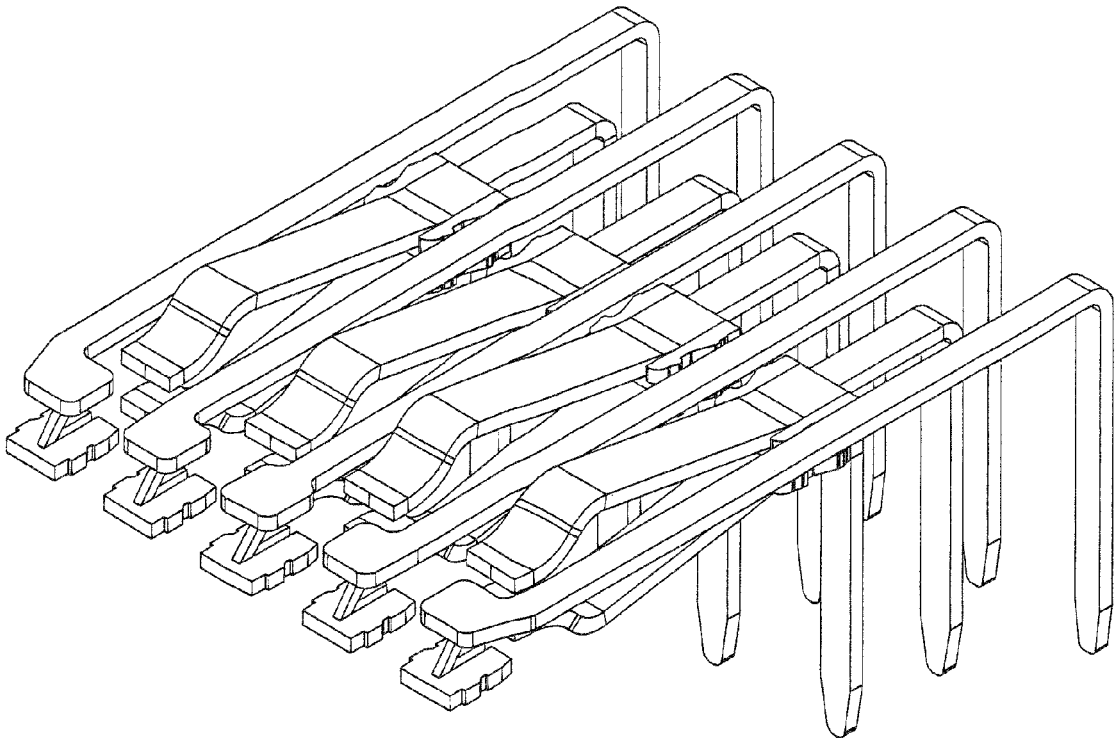
FIG. 12 is a perspective view showing another improved terminal structure according to the present invention.
Figure 13:
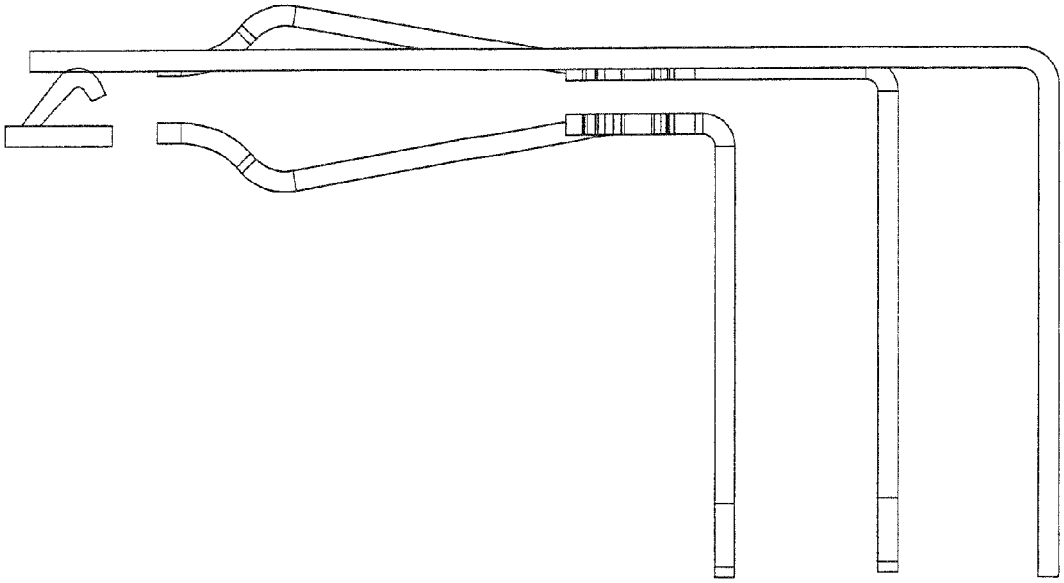
FIG. 13 is a side elevational view of FIG. 12.

Next, referring to FIGS. 12 and 13, the present invention discloses another improved terminal structure of connector, which comprises a terminal group 2, which comprises a plurality of terminals 21', a plurality of non-opposing terminals 22, and a plurality of opposing terminals 23. The plurality of opposing terminals 23 comprises at least one terminal that is a resilient terminal. The plurality of terminals 21 comprises at least one terminal that forms a projecting section 211. The projecting section 211 of the plurality of terminals 21' is in electrical engagement with the plurality of non-opposing terminals 22 and the plurality of opposing terminals 23 is electrically connected to each other.

Figure 14:
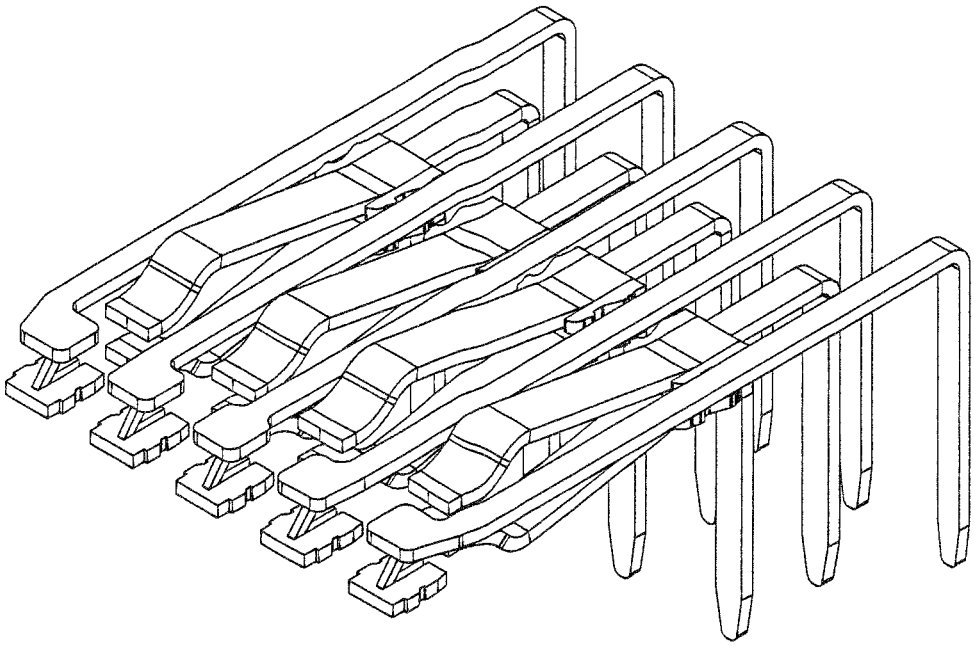
FIG. 14 is a perspective view showing another improved terminal structure according to the present invention.
Figure 15:
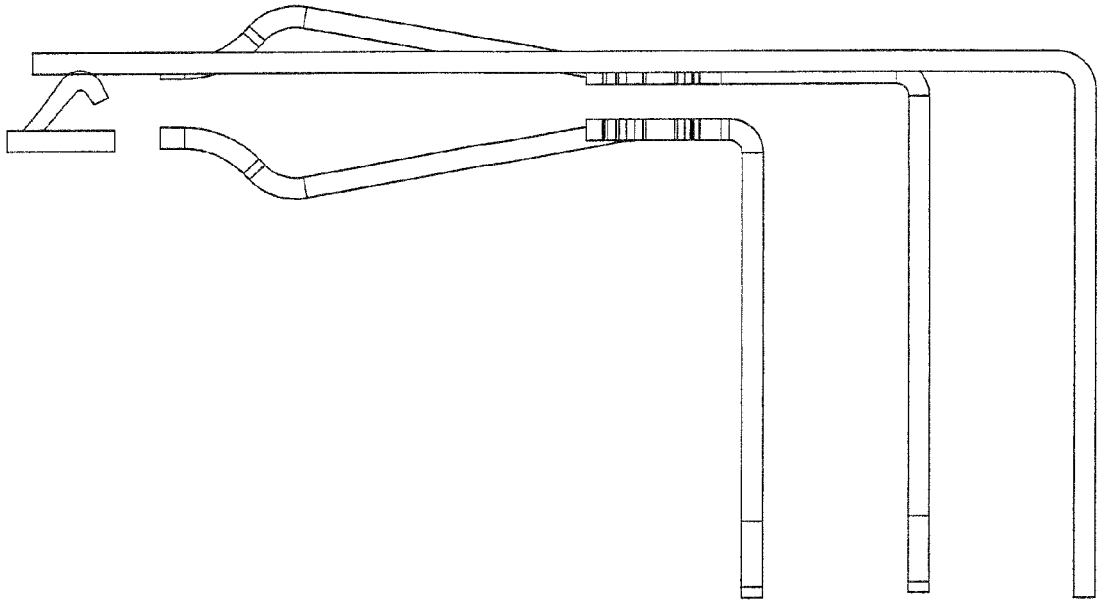
FIG. 15 is a side elevational view of FIG. 14.

Referring to FIGS. 14 and 15, the present invention discloses another improved terminal structure of connector, which comprises a terminal group 3, and the terminal group 3 comprises a plurality of terminals 31', a plurality of non-opposing terminals 32, and a plurality of opposing terminals 33. The plurality of opposing terminals 33 comprises at least one terminal that is a resilient terminal. The plurality of terminals 31' comprises at least one terminal that forms a projecting section 311. The projecting section 311 of the plurality of terminals 31' is in electrical engagement with the plurality of non-opposing terminals 32.

Figure 16:
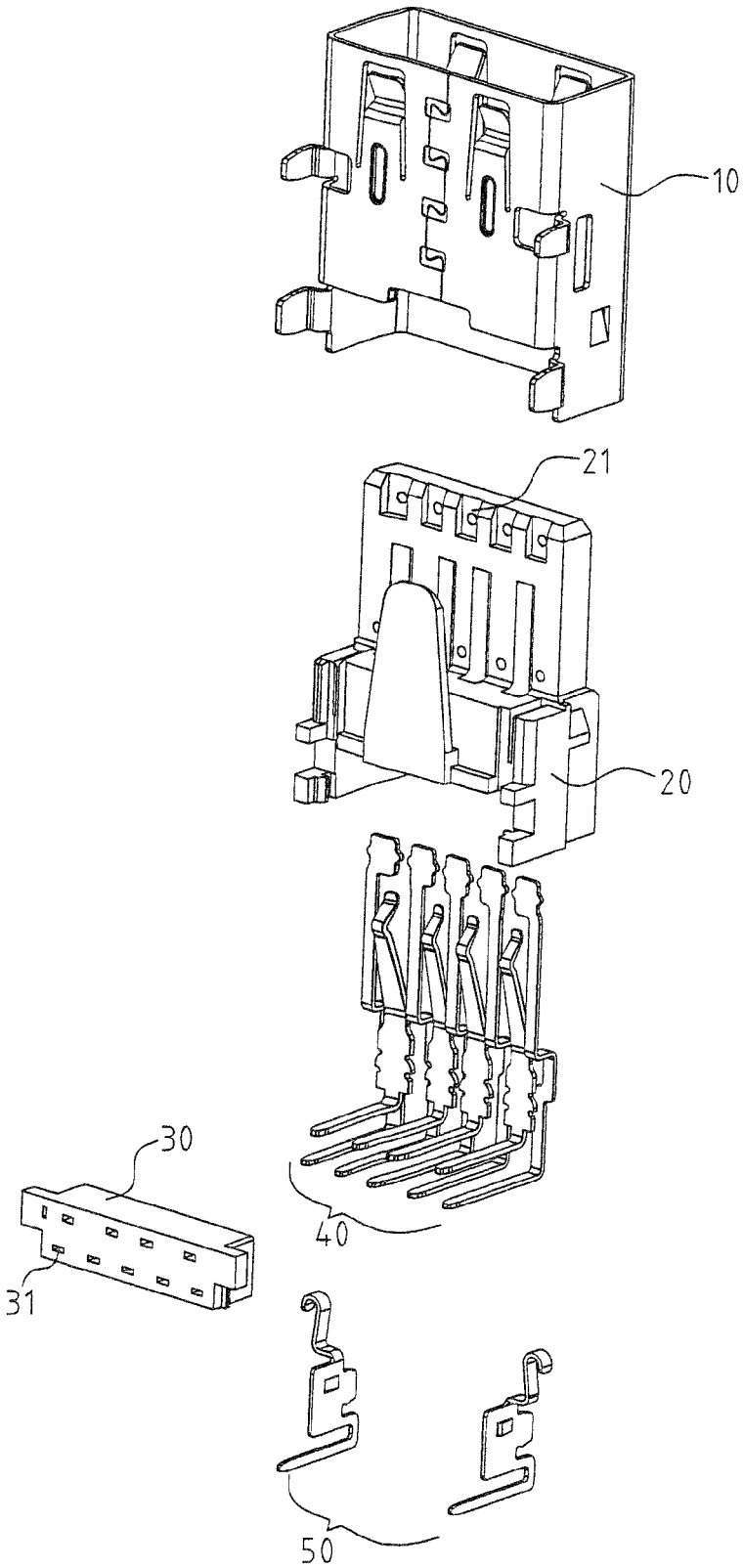
FIG. 16 is an exploded view of a connector port incorporating terminals according to another embodiment of the present invention.
Figure 17:
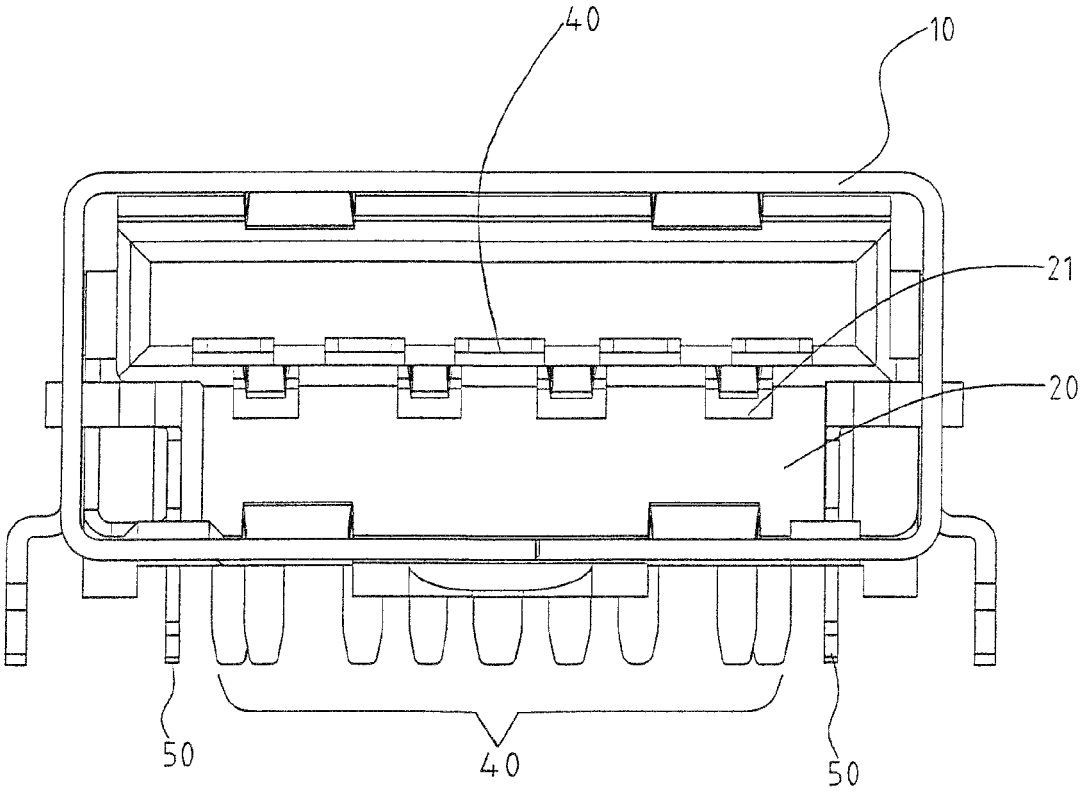
FIG. 17 is a front view of the connector port incorporating the terminals according to said another embodiment of the present invention.
Figure 18:
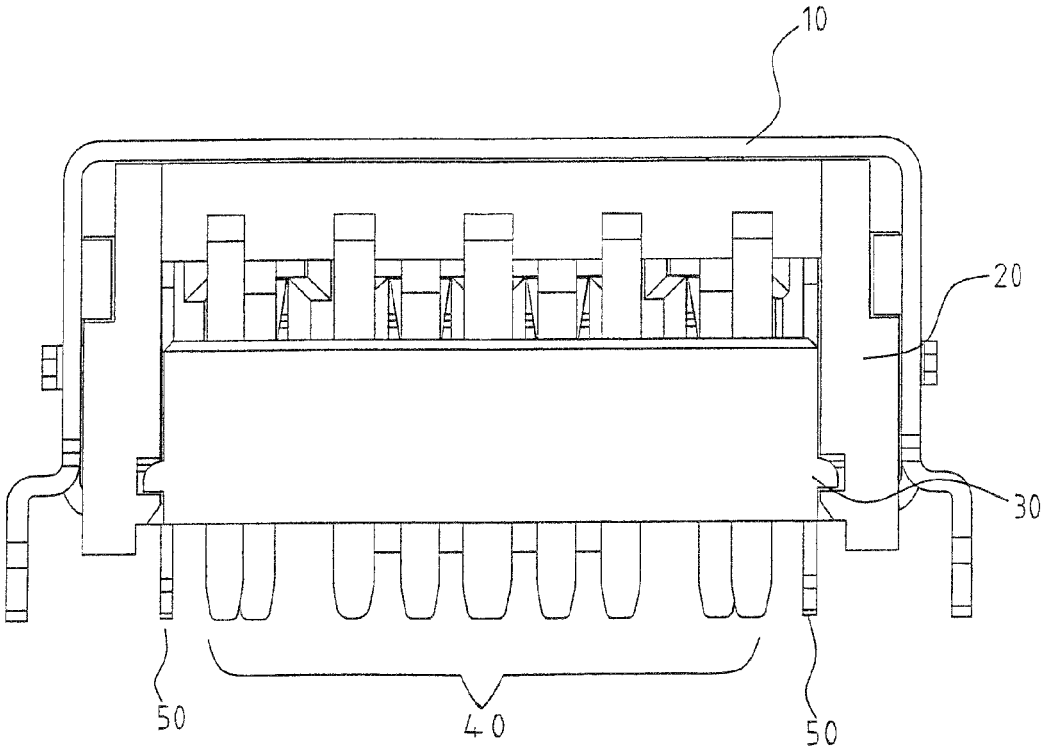
FIG. 18 is a rear view of the connector port incorporating the terminals according to said another embodiment of the present invention.

Referring to FIGS. 16-18, which are views illustrating an embodiment of a socket connector according to the present invention. A plurality of terminal groups 40 is provided as terminal groups complying with the specification of universal serial bus (USB3.0A), and is arranged on a tongue plate 21 located inside an insulation housing 20. Further, the plurality of terminal groups 40 and terminal tips of a plurality of detection pins 60 are positioned in a plurality of slots 31 defined in a retainer seat 30. The retainer seat 30 is coupled to the insulation housing 20, and the insulation housing 20 is received and retained in a hollow shell 10 to form a structure of opening.

An external plug connector, when fit into the socket, engages the plurality of detection pins 60 to form a closed loop circuit and thus prevent shorting. Further, the socket may be connected to an electrical device, which is for example a circuit board 80 or electrical cable (not shown).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A terminal structure, comprising:

a terminal group, which comprises a plurality of terminals, of which at least one terminal having a front end having a portion that is inclined to form an inclination section that is partially separated from the terminal, the inclination section being extended in a substantially horizontal direction to then form a bent section;

wherein when the terminal group is set in a connector port, the bent section of the terminal is electrically engageable with at least one terminal of an external plug;

the connector port comprising:

a hollow shell, which receives and retains therein an insulation housing that comprises a tongue plate on which a plurality of terminals is arranged;

a first terminal group, which comprises a plurality of first terminals and is arranged in the insulation housing, the first terminal group being adapted to electrically engage corresponding terminals of an external plug connector;

a second terminal group, which comprises a plurality of second terminals and a plurality of third terminals and is arranged in the insulation housing, the second terminal group being adapted to electrically engage corresponding terminals of the external plug connector;

at least one detection pin, which is arranged in the insulation housing, the detection pin being adapted to engage the external plug connector;

a plurality of clamps, which is arranged in the insulation housing, the clamps functioning to clamp and position the external plug connector;

a retainer seat, which forms a plurality of slots that receives and positions the terminals of first and second terminal groups and the detection pin;

wherein the retainer seat is coupled to the insulation housing.

2. The connector port according to claim 1, wherein the plurality of first terminals of the first terminal group is a terminal group in compliance with USB2.0A or 3.0A.

3. The connector port according to claim 1, wherein the plurality of second terminals and the plurality of third terminals of the second terminal group are terminal groups in compliance with external SATA (eSATA), and the plurality of third terminals is also a terminal group in compliance with USB2.0A or 3.0A.

4. The connector port according to claim 1, wherein the plurality of third terminals is of a curved structure.

5. The connector port according to claim 3, wherein the plurality of third terminals is of a curved structure.

6. The connector port according to claim 1, wherein the insulation housing forms an opening of variable width.

7. The connector port according to claim 6, wherein the opening has an upper portion and a lower portion, which selectively and individually receives an external plug connector of the same specification, the plug comprising terminals electrically engageable with corresponding terminals of the port.

* * * * *